US009396636B2

(12) United States Patent
Wallace et al.

(10) Patent No.: US 9,396,636 B2
(45) Date of Patent: Jul. 19, 2016

(54) PNEUMATIC PRESSURE DETECTOR FOR A FIRE ALARM SYSTEM AND METHOD OF INSULATING

(71) Applicant: Kidde Technologies, Inc., Wilson, NC (US)

(72) Inventors: Steven Wallace, Raleigh, NC (US); David Frasure, Wilson, NC (US); Mahamadou Yamoussa, Raleigh, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 0 days.

(21) Appl. No.: 14/537,407

(22) Filed: Nov. 10, 2014

(65) Prior Publication Data

US 2016/0133106 A1 May 12, 2016

(51) Int. Cl.

| | |
|---|---|
| ***G08B 21/00*** | (2006.01) |
| ***G08B 17/04*** | (2006.01) |
| *H01H 1/00* | (2006.01) |
| *G08B 1/00* | (2006.01) |

(52) U.S. Cl.
CPC . *G08B 17/04* (2013.01); *G08B 1/00* (2013.01); *H01H 1/00* (2013.01)

(58) Field of Classification Search
CPC ..... G08B 1/00; H01H 1/00
See application file for complete search history.

(56) References Cited

U.S. PATENT DOCUMENTS

| | | | | |
|---|---|---|---|---|
| 2,358,911 A | | 9/1944 | Devine | |
| 3,122,728 A | | 2/1964 | Lindberg, Jr. | |
| 3,609,620 A | * | 9/1971 | Lee | H01H 61/02 337/102 |
| 5,136,278 A | | 8/1992 | Watson et al. | |
| 5,251,473 A | * | 10/1993 | Reese | B60S 5/02 137/264 |
| 5,360,269 A | * | 11/1994 | Ogawa | G01K 1/105 136/234 |
| 5,691,702 A | | 11/1997 | Hay | |
| 6,570,333 B1 | * | 5/2003 | Miller | B64C 23/00 118/723 I |
| 7,021,147 B1 | | 4/2006 | Subramanian | |
| 2009/0096120 A1 | | 4/2009 | Subramonian | |
| 2009/0236205 A1 | * | 9/2009 | Nalla | G08B 17/04 200/81.4 |
| 2011/0121977 A1 | | 5/2011 | Nalla et al. | |
| 2012/0280699 A1 | * | 11/2012 | Kerl | G01R 31/14 324/659 |

FOREIGN PATENT DOCUMENTS

| | | | |
|---|---|---|---|
| AU | 478116 B2 | 9/1975 | |
| WO | 2009032973 A2 | 3/2009 | |

OTHER PUBLICATIONS

European Search Report regarding related EP App. No. 15193927.9; issued Apr. 4, 2016; 9 pgs.

* cited by examiner

*Primary Examiner* — Shirley Lu
(74) *Attorney, Agent, or Firm* — Cantor Colburn LLP

(57) ABSTRACT

A pneumatic pressure detector for a fire alarm system includes a housing having an internal surface defining an interior volume. Also included is an alarm switch located within the interior volume of the housing and comprising a first deformable diaphragm responsive to an increase in pressure of a gas disposed in a sensor tube to indicate an overheat condition. Further included is an integrity switch located within the interior volume and comprising a second deformable diaphragm disposed in contact with an electrical contact during pressurization of the gas within a predetermined pressure range and in an electrically open condition when the pressure of the gas is less than the predetermined range. Yet further included is a mica sleeve located within the interior volume of the housing and disposed along at least a portion of the internal surface of the housing to insulate the alarm switch and the integrity switch.

7 Claims, 1 Drawing Sheet

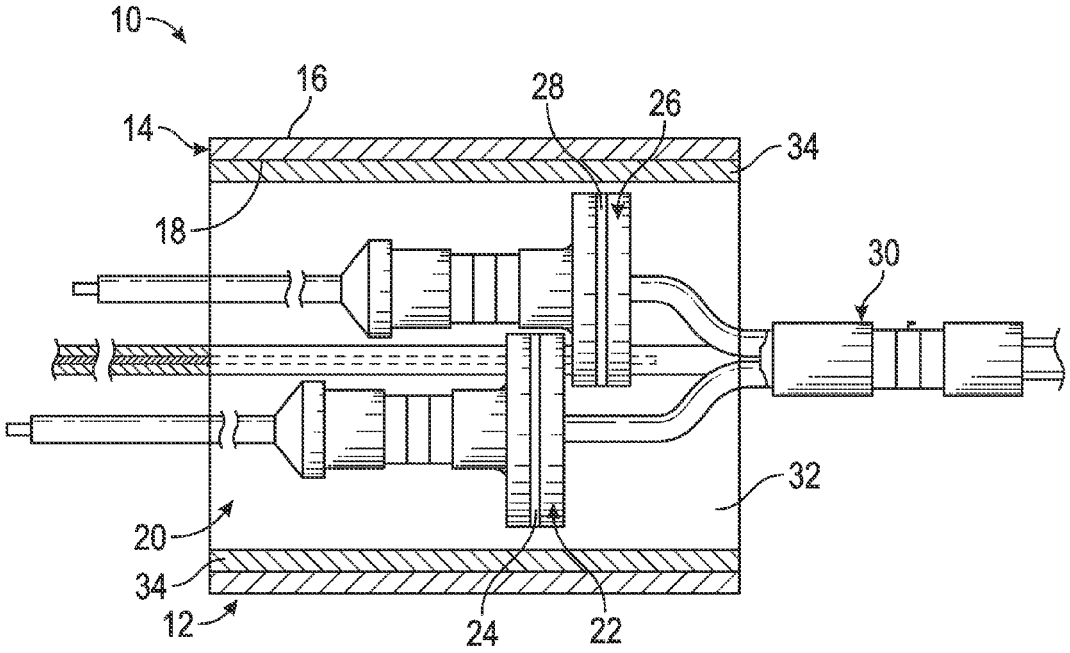
10
16
28
26
14
34
18
30
32
20
34
12
24
22

PNEUMATIC PRESSURE DETECTOR FOR A FIRE ALARM SYSTEM AND METHOD OF INSULATING

BACKGROUND OF THE INVENTION

The subject matter disclosed herein relates to fire alarm systems and, more particularly, to a pneumatic pressure detector for a fire alarm system, as well as a method of insulating switches of the pneumatic pressure detector.

Fire alarm systems are employed to detect an overheat condition (e.g., fire) in a wide number of applications in many industries. For example, it is important to detect overheat conditions on aircraft or commercial vehicles. One approach is a pneumatic pressure detector that is part of a system that uses a gas that expands when heated. Upon heating, the gas actuates an associated deformable diaphragm, as well as any other type of switch, to close an electrical switch (e.g., fire alarm switch) to indicate an alarm condition. An integrity switch, or fault switch, also utilizes a deformable diaphragm. The integrity switch is electrically closed under normal operation, but will electrically open if the pneumatic pressure falls below a calibrated pressure. The fire alarm switch and the integrity switch are located, sealed and insulated within a housing.

Aerospace fire resistance standards ISO 2685 and AC 20-135 require that the housing pass a 2000° F. flame test for at least five minutes. The tests require that the housing containing the switches be located directly in the flame for the entire test, and that the pneumatic fire detector must operate as intended during this time. A challenge during the test is to protect the two pressure switches so that they are not exposed to the full heat load of the test. Switches exposed to too much heat during the test can result in the pressure setting dropping significantly, resulting in the pneumatic fire detector failing to either indicate the fire has been removed or the integrity pressure switch failing to indicate a severed sensing element.

Typically, the switches are potted in the housing in a manner to protect them from the full heat load of the 2000° F. flame. The potting material is put into the housing and cured at room temperature. During the test, it is possible that the viscosity of the potting material can change allowing the potting material to move and become reoriented within the housing. If this happens, the potting material can put excessive stresses on the switches and the pressure tubes attached to the switches as it cools when it is removed from the fire. These undue stresses may cause some type of failure or leak to occur during the cooling process resulting in a non-functioning pneumatic fire detector.

It should be noted that various potting materials are available for use, some of which are fire resistant, and others which can withstand extreme temperatures. However, under the full heat load of the five minute test at 2000° F., they all, to some degree, can experience a dimensional change due to thermal expansion and some also can outgas substances which can have detrimental material compatibility issues. It would also be possible that as the potting material expands during the test, the switches themselves could become reoriented causing them to come in contact with the metal housing and creating a dielectric failure. Another possibility is that as the potting material cools when it is removed from the fire the stress or force caused by the potting material's thermal contraction process could crack the interfacing pressure tubes. This is particularly true if the pressure tube material has been sensitized due to material compatibility issues.

BRIEF DESCRIPTION OF THE INVENTION

According to one aspect of the invention, a pneumatic pressure detector for a fire alarm system includes a housing having an internal surface defining an interior volume. Also included is at least one alarm switch located within the interior volume of the housing and comprising a first deformable diaphragm responsive to an increase in pressure of a gas disposed in a sensor tube to indicate an overheat condition. Further included is at least one integrity switch located within the interior volume of the housing and comprising a second deformable diaphragm disposed in contact with an electrical contact during pressurization of the gas within a predetermined pressure range and in an electrically open condition when the pressure of the gas is less than the predetermined range. Yet further included is a mica sleeve located within the interior volume of the housing and disposed along at least a portion of the internal surface of the housing to insulate the alarm switch and the integrity switch.

According to another aspect of the invention, a method of insulating switches of a pneumatic pressure detector for a fire alarm system is provided. The method includes installing a fire alarm switch within an interior volume of a housing, the interior volume defined by an internal surface of the housing. The method also includes installing an integrity switch within the interior volume of the housing. The method further includes insulating the fire alarm switch and the integrity switch with a mica sleeve located within the interior volume and disposed along at least a portion of the internal surface of the housing.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 1 is a partial cross-sectional view of a pneumatic pressure detector for a fire alarm system.

The detailed description explains embodiments of the invention, together with advantages and features, by way of example with reference to the drawings.

DETAILED DESCRIPTION OF THE INVENTION

Referring to FIG. 1, a portion of a fire alarm system 10 is illustrated. Specifically, a pneumatic pressure detector 12 of the fire alarm system 10 is shown. The fire alarm system 10 may be employed in any location that requires the use of an overheat condition, such as that caused by a fire. It is to be appreciated that the fire alarm system 10 may be employed in numerous industries, such as the aerospace industry, where the fire alarm system 10 is disposed on an aircraft.

The pneumatic pressure detector 12 includes a housing 14 that is constructed out of a metallic material that is capable of conducting an electrical signal. Metallic materials are used so that components disposed therein can maintain their strength when they are subjected to high temperatures. The housing 14 includes an exterior surface 16 and an internal surface 18, with the housing 14 having a substantially cylindrical cross-section in some embodiments. However, alternative cross-sectional geometries are contemplated. The internal surface 18 defines an interior volume 20.

Disposed within the interior volume 20 are various components configured to detect different pressure conditions indicative of environmental conditions (e.g., overheat condition). A first switch, referred to herein as an integrity switch 22, is located within the interior volume 20 and is disposed in a closed condition during normal operation in the absence of an overheat condition. The integrity switch 22 includes a first deformable diaphragm 24 that is in contact with an electrical contact during a normal operating condition. Also disposed within the interior volume 20 is a second switch, referred to herein as an alarm switch 26, and is disposed in an open condition during normal operation of the pneumatic pressure detector 12. The alarm switch 26 includes a second deformable diaphragm 28 that is not in contact with an electrical contact if the pressure within a pressure tube 30 is maintained below a predetermined pressure range as will be described in detail below.

The pressure tube 30 extends through the housing 14 and into the interior volume 20. The pressure tube 30 contains a gas that expands as it is heated. Therefore, as pressure tube 30 is heated the pressure in pressure tube 30 will increase. As the pressure in the pressure tube 30 increases, the pressure in the interior volume of switches 22 and 26 will also increase. The pressure in the pressure tube 30 can cause the deformable diaphragms 24, 28 to deform. The pressure tube 30 will be placed next to components that are capable of overheating or components where a fire could occur, such as an engine, for example.

Pressure changes within the pressure tube 30 of the housing 14 cause the integrity switch 22 and the alarm switch 26 to actuate upon certain predetermined pressure changes. A large enough pressure increase that reaches a critical level, which will vary depending upon the particular application, will cause the second deformable diaphragm 28 to deform to close the switch, thereby indicating an alarm condition. Conversely, a significant drop in pressure that falls below a predetermined pressure range causes the first deformable diaphragm 24 to deform to open the switch, thereby indicating a fault condition of the pneumatic pressure detector 12. Such a pressure drop may occur if the sensor tube is damaged.

It is important to protect components, including the alarm switch 26 and the integrity switch 22, within the interior volume 20 from the heat that they are exposed to during an overheat condition, including during testing of the pneumatic pressure detector 12. A potting material 32 is provided in the interior volume 20 to encapsulate and insulate the alarm switch 26 and the integrity switch 22. Various potting materials may be employed, but are prone to viscosity changes during heating, which poses various risks to the switches 22, 26. Various potting materials are contemplated. In one embodiment, the potting material 32 comprises fused silica, which is particularly advantageous based on its low coefficient of expansion and low thermal conductivity properties. Such a material cures into a solid form and has a maximum operating temperature of greater than 2000° F.

To further protect the switches 22, 26, a mica sleeve 34 is applied proximate the internal surface 18 of the housing 14. The mica sleeve 34 is disposed along at least a portion of the internal surface 18 to electrically and thermally insulate the potting material 32, which is located at a further interior region than the mica sleeve 34. The properties of mica, which include low thermal and electrical conductivity, thereby making it an excellent electrical and thermal insulator, results in a high resistance to heat to protect the potting material 32 and hence the switches 22, 26.

The mica sleeve 34 may be disposed along only a portion of the internal surface 18, such as those where the switches 22, 26 are in close contact with the internal surface 18. In other embodiments, the mica sleeve 34 is disposed along an entirety of the internal surface 18 to ensure thermal and electrical isolation of the potting material 32 and the switches 22, 26. The thickness of the mica sleeve 34 may vary depending upon the particular application. In some embodiments, the mica sleeve 34 has a volume less than the volume of the potting material 32. In other words, less of the available insulating volume of the interior volume 20 is comprised of mica, relative to the potting material 32. In other embodiments, the mica sleeve 34 has a volume greater than the volume of the potting material 32. An extreme case includes an embodiment having the entire available insulating volume of the interior volume 18 filled with mica.

Although described above as a sleeve formed of mica, it is to be appreciated that alternatives to mica may be employed as the additional layer of insulation. Any material having the properties discussed above relating to low electrical and thermal conductivity may be suitable for use as the sleeve. Regardless of the precise material used, the embodiments described herein are suitable to withstand heat testing at 2,000° F. for at least five minutes.

Advantageously, the mica sleeve 34 guarantees the required electrical isolation between the switches 22, 26 and the metal housing 14, while providing enhanced thermal resistance to minimize any viscosity changes in the potting material. Additionally, mica is lighter than any of the potting materials on a volumetric basis. Therefore, mica reduces the final produce weight of the pneumatic pressure detector 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A pneumatic pressure detector for a fire alarm system comprising:

a housing having an internal surface defining an interior volume;

at least one alarm switch located within the interior volume of the housing and comprising a first deformable diaphragm responsive to an increase in pressure of a gas disposed in a sensor tube to indicate an overheat condition;

at least one integrity switch located within the interior volume of the housing and comprising a second deformable diaphragm disposed in contact with an electrical contact during pressurization of the gas within a predetermined pressure range and in an electrically open condition when the pressure of the gas is less than the predetermined range;

a mica sleeve located within the interior volume of the housing and disposed along at least a portion of the internal surface of the housing to insulate the alarm switch and the integrity switch; and a potting material disposed in the interior volume of the housing to encapsulate and insulate the alarm switch and the integrity switch, the potting material disposed at an interior region of the mica sleeve and insulated by the mica sleeve, wherein the mica sleeve has a mica volume and the potting material has a potting volume, the mica volume greater than the potting volume.

2. The pneumatic pressure detector of claim 1, wherein the mica sleeve is disposed along the entirety of the internal surface of the housing.

3. The pneumatic pressure detector of claim 1, wherein the pneumatic pressure detector withstands normal operating conditions under 2,000° F. for a duration of five minutes.

4. The pneumatic pressure detector of claim 1, wherein the housing comprises a cylindrical cross-sectional geometry.

5. The pneumatic pressure detector of claim 1, wherein the potting material comprises fused silica.

6. A method of insulating switches of a pneumatic pressure detector for a fire alarm system, the method comprising:

installing a fire alarm switch within an interior volume of a housing, the interior volume defined by an internal surface of the housing;

installing an integrity switch within the interior volume of the housing;

insulating the fire alarm switch and the integrity switch with a mica sleeve located within the interior volume and disposed along at least a portion of the internal surface of the housing; and encapsulating and insulating the fire alarm switch and the integrity switch with a potting material located within the interior volume of the housing, wherein the mica sleeve surrounds at least a portion of the potting material to insulate the potting material, wherein the mica sleeve has a mica volume and the potting material has a potting volume, the mica volume greater than the potting volume.

7. The method of claim 6, wherein insulating with the mica sleeve comprises disposing the mica sleeve along the entirety of the internal surface of the housing.

* * * * *